US005836370A

United States Patent [19]

Naruse

[11] Patent Number: 5,836,370

[45] **Date of Patent: *Nov. 17, 1998**

[54] METHOD OF MANUFACTURING LOW-MELTING POINT METAL CORES

[75] Inventor: Eiji Naruse, Toyokawa, Japan

[73] Assignee: Sintokogio, Ltd., Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 687,163

[22] Filed: Jul. 24, 1996

[30] Foreign Application Priority Data

Jul. 28, 1995 [JP] Japan ..... 7-212559

[51] Int. Cl.[6] ..... B22D 18/04; B22D 23/00

[52] U.S. Cl. ..... 164/77; 164/119

[58] Field of Search ..... 164/77, 119, 306

[56] References Cited

FOREIGN PATENT DOCUMENTS 2124526 2/1984 United Kingdom ..... 164/77

*Primary Examiner*—Kuang Y. Lin

*Attorney, Agent, or Firm*—Limbach & Limbach L.L.P.

[57] ABSTRACT

A method of manufacturing a low melting-point metal core is provided, which consists of fitting a loose piece 6 having a built-in heater 5 in a mold 4, casting molten metal by pushing it up from a furnace into the cavity of the mold 4 to fill it, keeping the mold in a filled state for a given time, and stopping the casting step at a time at which the molten metal at the central part of the cavity is still unsolidified, so as to have the unsolidified molten metal fall freely into the furnace.

2 Claims, 2 Drawing Sheets

METHOD OF MANUFACTURING LOW-MELTING POINT METAL CORES

TECHNICAL FIELD OF THE INVENTION

This invention relates to a method of manufacturing a low melting-point metal core used when a plastic manifold is molded.

BACKGROUND OF THE INVENTION

A conventional core formed by casting a low melting-point metal has been used for manufacturing a plastic manifold used as an air-inlet manifold for an automobile engine. However, the core has several drawbacks in that: the core is heavy and cumbersome in handling since it is cast with a low melting-point metal such as bismuth or antimony and thus is heavy; and after it has been used as a core, it takes much time to melt away while it is being wrapped in the plastic manifold to separate the plastic manifold therefrom by dipping it into a heated liquid (for example, ethylene glycol), or by melting the core part by induction heating, since the metal core is gradually melted from its exposed part.

This invention has been made by considering the above-mentioned problems. The purpose of this invention is to provide a method of manufacturing a low melting-point metal core, wherein the weight of the core is reduced, and at the same time it can be quickly melted away after it has been used as a core, so as to be simplify the process to produce resin manifolds.

SUMMARY OF THE INVENTION

To achieve the above-mentioned purpose, the method of this invention, wherein molten metal held in a low-pressure casting machine equipped with a stalk tube and a holding furnace is fed into a cavity of a mold disposed above the stalk tube, by applying a pressurized gas to the molten metal in the holding furnace, is characterized by fitting a loose piece in the mold so as to protrude into the cavity, the loose piece having a built-in heater for generating a temperature higher than the melting point of the core metal, feeding and filling the molten metal into the cavity by applying the pressurized gas to the furnace while the loose piece is being actuated to cast the metal, and depressurizing the furnace after the cavity has been held in a filled state for a given time, when the cast molten metal at the peripheral part of the cavity has solidified and at the same time the molten metal at the central part of the cavity is still unsolidified, so as to have the pressure inside the furnace return to atmospheric pressure, and so as to have the unsolidified molten metal fall freely by its own weight into the furnace via the stalk tube by pulling out the loose piece from the mold.

EMBODIMENT OF THE INVENTION

Figure 1:
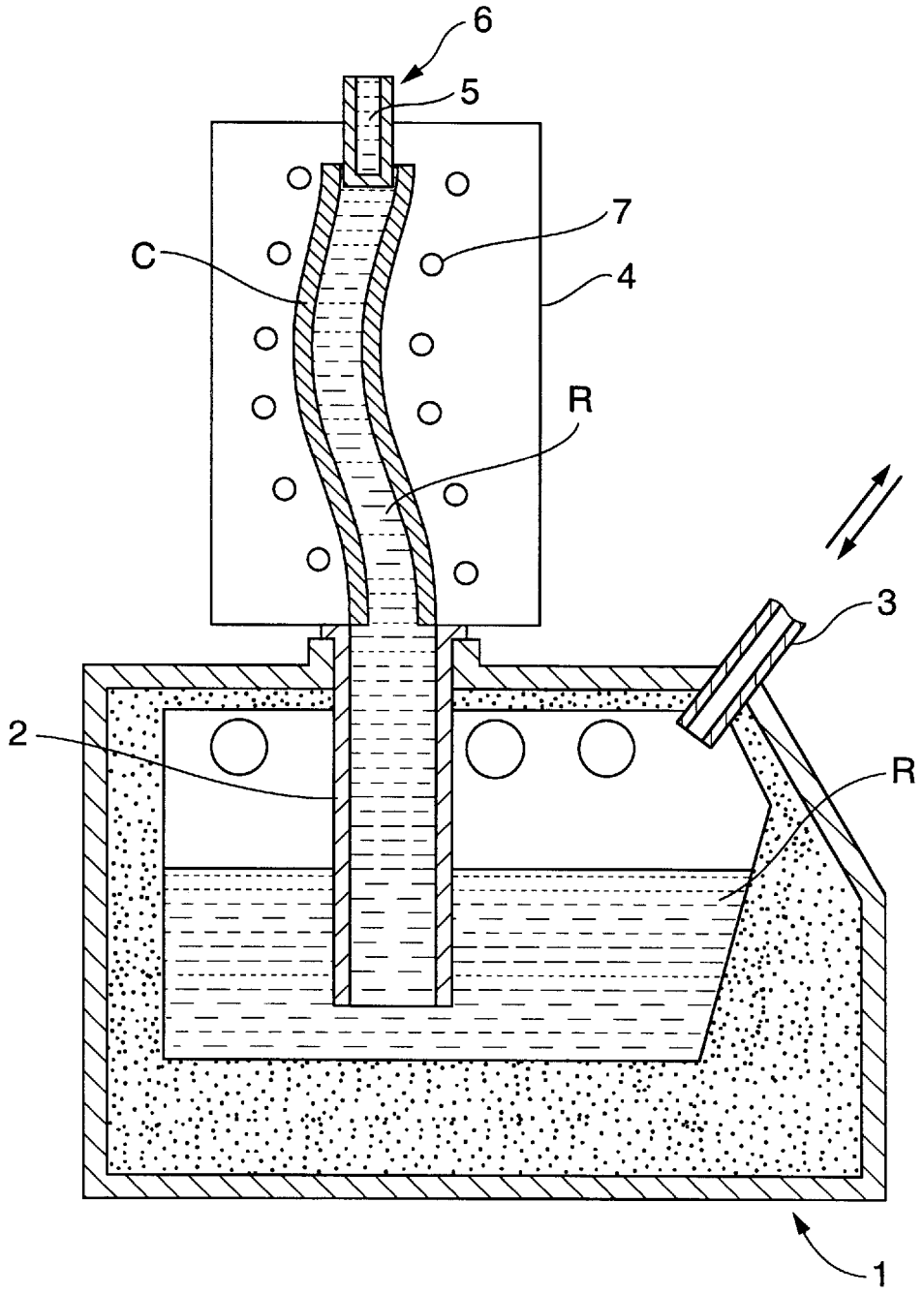
FIG. 1 is a sectional view showing an embodiment of this invention.

An embodiment of this invention will now be described in detail by reference to the drawings. In FIG. 1, a low-pressure casting machine is structured such that a holding furnace 1 for holding a melt of a low melting-point metal is equipped with a stalk tube 2, hanging freely from a part of the ceiling, and a gas supply-discharge tube 3 is disposed on the wall of the furnace 1 to supply pressurized gas into or discharge it from the inside the holding furnace 1. A vertically separable mold 4, consisting of two mold parts, is disposed above the stalk tube 2, and a loose piece 6, having a built-in heater 5 for generating a temperature higher than the melting point of the low melting-point metal, is fitted in a cavity in the ceiling of the mold where the two mold parts abut the lower end of the loose piece slightly protruding into the cavity. A plurality of fluid flow paths 7 are provided in the mold. They can also be replaced by one path formed in a spiral fashion. The thickness of the solidified low melting-point molten metal can be controlled, if it is designed to vary the thickness, by adjusting the temperature of the mold 4 by the fluid passing through the flow paths 7 so as to change the temperature of the surface portion of the molten metal. Under certain conditions the mold can be cooled by leaving it as is under a normal temperature.

The apparatus thus structured operates as follows: the bottom end of the loose piece 6 is fitted in the cavity of the mold 4 (by means not shown) so as to slightly protrude into the cavity, while the temperature of the mold 4 is controlled by passing a liquid through the flow paths 7; next, while a pressurized gas is supplied to the furnace via the gas supply-discharge tube 3 to exert a gas pressure on the upper surface of the molten metal R, the molten metal R is being introduced into the cavity of the mold 4 via the stalk 2, so that the cavity is kept in a filled state for a given time; thereby the introduced molten metal R is partly solidified, as shown by a core C at its peripheral part in the cavity, except for the part near the loose piece 6, while the molten metal remains unsolidified at the central part of the cavity (as shown in FIG. 1); in this state the gas supply to the holding furnace 1 is stopped and the gas is discharged via the gas supply-discharge tube 3 so as to restore atmospheric pressure inside the furnace 1; and then the loose piece 6 is pulled out from the ceiling part of the mold 4 (by means not shown) so that the unsolidified molten metal R in both the stalk tube 2 and the mold 4 falls by its own weight, and is thus returned to the holding furnace 1.

Figure 2:
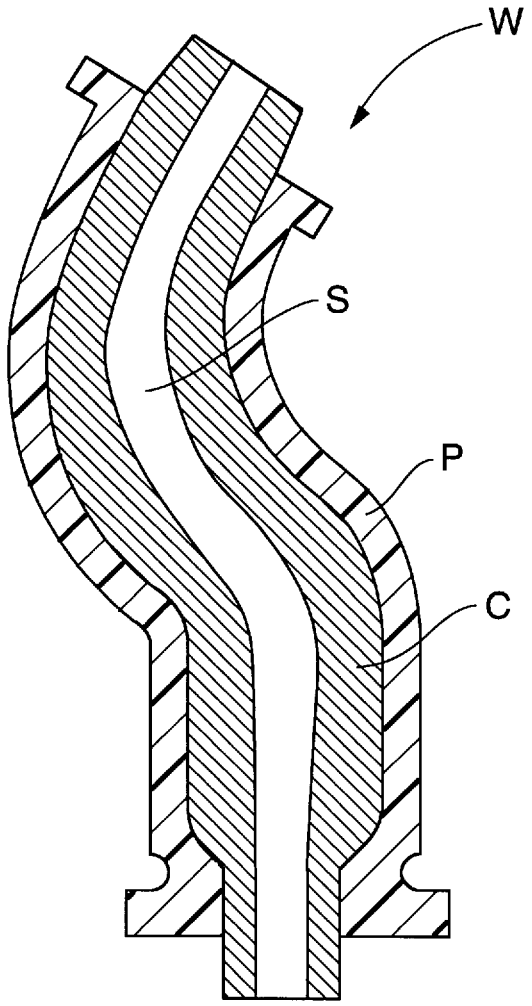
FIG. 2 is a sectional view of a half-finished plastic manifold molded by using a low melting-point metal core manufactured in accord with this invention.

A core C, having a vertical through hollow S, accordingly is cast in a low melting-point metal in the cavity of the mold 4. The mold is then separated where the mold parts are connected and the mold parts are removed from the core c. The thus-cast core C is used for molding a plastic manifold after it is taken out from the mold 4. In FIG. 2 the core C is wrapped in a cylindrical plastic manifold P, forming a half-finished product W. The plastic manifold P can be easily obtained from the half-finished product W by making a heated fluid (for example, ethylene glycol) flow through the hollow S or by dipping the half-finished product W in a tank containing a heated fluid so that the low-melting point metal core C is quickly and completely dissolved from all parts inside the manifold P. High-frequency electromagneic induction means can also be used to quickly obtain the plastic manifold P, since the core C is rapidly dissolved from all parts inside the manifold P.

As is clear from the above-mentioned descriptions, in this invention a low melting-point metal core having a vertical through hollow can be manufactured as follows: a low-melting point molten metal is pushed upward into the mold equipped with the loose piece, which is fitted in the ceiling part of the mold, and which has the built-in heater; the mold filled with the molten metal is kept for a given time at a given time, to cast a core; and the casting is stopped in a state wherein unsolidified molten metal still remains in the central part of the cavity in the mold so as to return it to the holding furnace. The thus-manufactured low melting-point metal core has various effects in that the core can be easily handled due to its reduced weight, and in that the core wrapped in a plastic manifold can be quickly dissolved after it has been used for molding the manifold.

What is claimed is:

1. A method of manufacturing a low-melting point metal core having a central through hole, wherein molten metal held in a low-pressure casting machine equipped with a stalk tube and a holding furnace is fed into a cavity of a mold disposed above the stalk tube, by applying a pressurized gas to the molten metal in the holding furnace, the method comprising the steps of:

fitting a loose piece in the mold so as to protrude into the cavity in a position for forming an entrance portion of the central through hole of the core to be cast, the loose piece having a built-in heater for generating a temperature higher than the melting point of the core metal, feeding and filling the molten metal into the cavity by applying the pressurized gas to the furnace while the loose piece is being heated to said temperature higher than the melting point of the core metal by actuating the heater, and depressurizing the furnace after the cavity has been held in a filled state for a given time, when the cast molten metal at the peripheral part of the cavity has solidified and at the same time the molten metal at the central part of the cavity is still unsolidified, and removing the loose piece from the mold while said molten metal at the central part of the cavity is still unsolidified so as to have the pressure inside the furnace return to atmospheric pressure, and so as to have the unsolidified molten metal fall freely by its own weight into the furnace via the stalk tube thereby forming the central through hole.

2. The method of claim 1, wherein the metal core is a pipe-shaped metal core, and the step of fitting positions the loose piece so as to form the entrance portion at one end of the core to be cast.

* * * * *